United States Patent [19]

Prusak

[11] Patent Number: 4,479,853

[45] Date of Patent: Oct. 30, 1984

[54] METHOD FOR THE MANUFACTURE OF RECORD STAMPERS

[75] Inventor: John J. Prusak, Indianapolis, Ind.

[73] Assignee: RCA Corporation, New York, N.Y.

[21] Appl. No.: 594,821

[22] Filed: Mar. 29, 1984

[51] Int. Cl.[3] ..... C25D 1/20

[52] U.S. Cl. ..... 204/5; 204/281

[58] Field of Search ..... 204/5, 4, 281

[56] References Cited

U.S. PATENT DOCUMENTS 2,905,614 9/1959 Porrata et al. ..... 204/281
3,801,476 4/1974 Roschmann et al. ..... 204/5
3,956,075 5/1976 Rohwer et al. ..... 204/5
4,394,341 7/1983 Wierschke ..... 264/225

*Primary Examiner*—Thomas Tufariello
*Attorney, Agent, or Firm*—Birgit E. Morris; Edward J. Sites

[57] ABSTRACT

An improved method for the manufacture of stampers having formed inner and outer edges is provided in which the inner and outer edges are electroformed in the required configuration by using electroforming guides at the inner edge, the outer edge and preferably both edges.

3 Claims, 5 Drawing Figures

METHOD FOR THE MANUFACTURE OF RECORD STAMPERS

This invention relates to a method for manufacturing stampers used in the pressing of molded records. More particularly, this invention is concerned with an improved method for forming the inner and outer edge of the stampers so as to increase the useful life of the stampers.

BACKGROUND OF THE INVENTION

In the manufacture of molded records, such as conventional audio records or the more recently developed capacitive electronic discs, a thermoplastic material is molded between a pair of metal disc-shaped parts referred to as stampers. The stampers have defined in their molding surface a spiral information track which contains a surface relief pattern corresponding to the program information desired to be reproduced on playback of a molded record pressed with the stampers.

Stampers are the end product of a multi-step process which is broadly referred to as matrixing. The first step of the matrixing process is to record the program information on a magnetic tape. The magnetic tape is used to control a tool which cuts a recording substrate with a spiral information track having a surface relief pattern corresponding to the recorded program information. The recording substrates which are typically employed are flat metal discs which have a layer of a relatively soft material formed on one surface thereof into which the spiral information track is cut.

The recording substrate having the spiral information track is replicated in a series of electroforming steps. In the first of the electroforming steps, a metal, such as nickel, is electrodeposited on the recorded surface of the recording substrate until a self-sustaining matrix of a predetermined thickness is obtained. The resulting electroformed matrix, called a master, is then separated from the recording substrate and replicated. After a predetermined thickness of metal has been deposited on the master, the resulting matrix, referred to as a mother, is separated from the surface of the master. The mother then in turn likewise replicated to produce a part referred to as a stamper. The stamper is a negative replica of the recording substrate. The stamper will have formed in its molding surface a mirror image of the spiral information track which was originally cut into the recording substrate and will be of a flat disc-shaped configuration like the recording substrate.

The stampers obtained directly from the matrixing process described above are not suitable as formed for use in the presses conventionally employed in the molding of records. The flat stampers obtained from the above-described matrixing process are in effect stamper blanks which must be subjected to a number of edge shaping steps in order to have the required configuration for mounting on the molding platens of conventional record molding presses. The flat stampers from the matrixing process are trimmed. A center hole is cut into the flat stampers which has a precise diameter and is concentric with the information area of the stamper. The outer edge of the flat stamper is also trimmed to a precise diameter concentric with the information area of the stampers. After the stampers are trimmed, the inner and outer edges are further shaped in stamping operations. The inner edge is stamped to form a tube-like extension about the center hole which is used to secure the center of the stamper to the molding platen. The outer edge of the stamper is likewise shaped in a stamping operation which results in the outer edge being shaped so as to mold an outer bead on the molded record as well as to form the flash and provide a land area for molding. In addition, a circumferential section is formed about the outermost edge for engaging the outer edge of the molding platen.

The requirement for shaping of the inner and outer edges of the stampers is a source of considerable problems. It is highly desirable that the stampers be as hard as possible so as to resist scratching, dents and other types of mechanical damage during handling and pressing. However, since the flat stampers from the matrixing process are shaped in stamping operations as noted above, it is also necessary that the metal of the stampers be sufficiently ductile to permit deformation during stamping without cracking occuring, either as the stampers are shaped, or thereafter when the stampers are in the mold. The requirement for ductility of flat stampers manufactured by the above-described matrixing process has resulted in there being an undesirable tradeoff of hardness for ductility. Furthermore, it has been found that despite compromises being made in the hardness in order to obtain ductility, almost all of the problems encountered with conventional stampers during the pressing of records can be directly traced back to the stamping steps used to shape the inner and outer edges. The stampers having the edges shaped by stamping as described above, when used in the molding of records, usually fail as a result of fatigue cracking at the outer edge of the stampers. This is believed to be due to the stresses that are introduced into the shaped outer edge during stamping and to thinning of the metal of the shaped outer edge. Occasionally cracking problems are also encountered at the shaped inner edge.

What would be highly desirable would be an improved method for the manufacture of stampers having a relatively high hardness in the recorded areas and increased resistance to fatigue cracking at the formed inner and outer edges.

BRIEF SUMMARY OF THE INVENTION

An improved method for the manufacture of stampers having formed inner and outer edges is provided in which the inner and outer edges are electroformed in the required configuration by using electroforming guides at the inner and outer edges.

DETAILED DESCRIPTION

Figure 1:
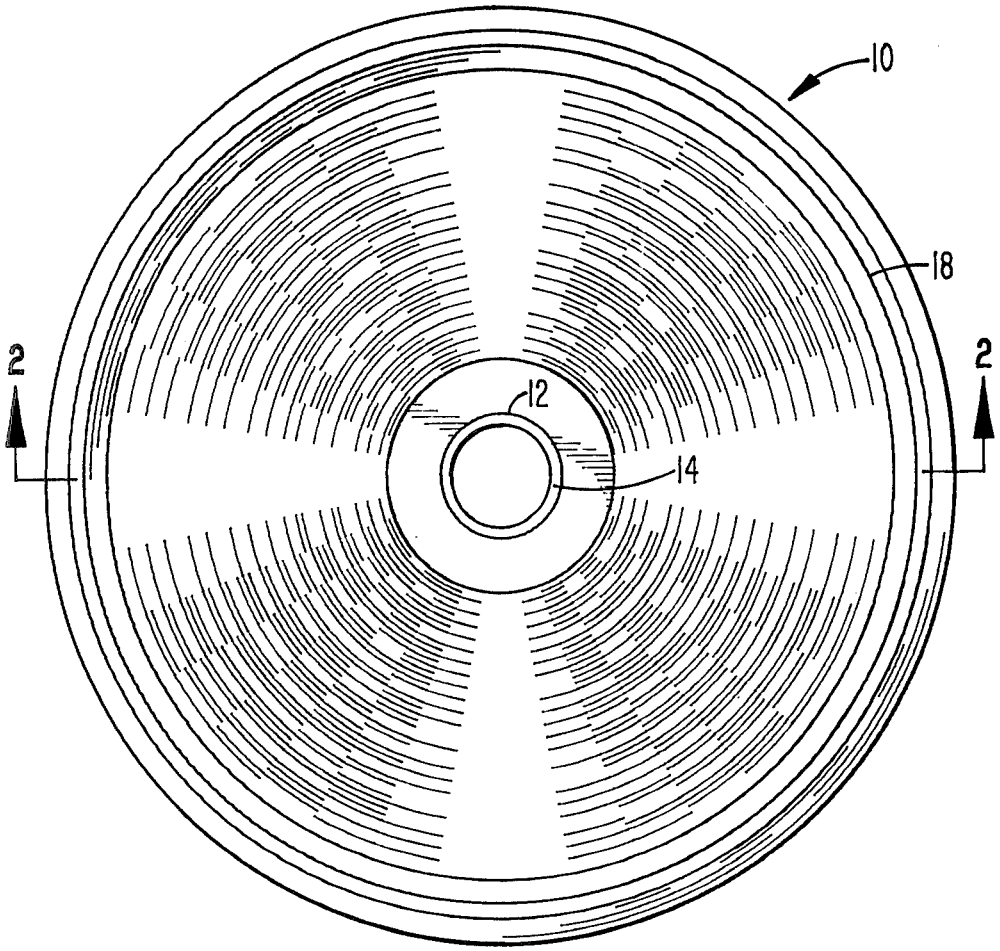
FIG. 1 is a top plan view of a record stamper having formed inner and outer edges.
Figure 2:
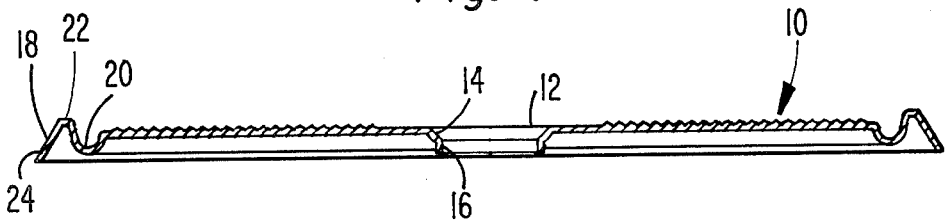
FIG. 2 is a cross-sectional illustration of the stamper of FIG. 1 taken as indicated by the line and arrows 2 on FIG. 1.

The stamper 10 illustrated in FIGS. 1 and 2 has a formed inner edge 12 of a predetermined configuration selected to mate with the center hole in the molding platen (not shown) of the record press and the molding pin (not shown) used to secure the stamper 10 to the molding platen. The inner edge 12 has a beveled section 14 and a straight section 16.

The stamper 10 illustrated in FIGS. 1 and 2 also has a formed outer edge 18 of a predetermined configuration. The outer edge 18 has a curved section 20 which is used to mold a protective bead on the molded record. The outer edge 18 also has a flat section 22 which is used to form a thin section in the flash and also to act as a molding land. The outer edge 18 further has an outer section 24 which is bent so as to be able to be engaged by the ring (not shown) used to secure the stamper 10 to the outer edge of the molding platen.

The configuration of the inner and outer edges 12, 18 is relatively complex and it is important that the inner and outer edges 12, 18 be formed to relatively exact dimensions in order to assure proper fit of the stamper 10 to the molding platen. It is also important that the inner and outer edges 12, 18 be relatively strong as most of the forces encountered in the molding cycle are concentrated at the inner and outer edges 12, 18. However, using the prior art method of stamping to shape the inner and outer edges 12, 18, the edges are inherently weak as a result of the metal being stretched and placed under stress.

In the method of the present invention, the entire stamper 10, including the outer edge 18, and preferably both the inner and outer edges 12, 18, are electroformed in the required configuration. The stamper 10 can be electroformed from various metals, metal alloys and bimetallic combinations of metals. The most commonly used metal is nickel which is electrodeposited from a nickel sulfamate bath. Using the method of this invention, it is highly advantageous to electroform the stamper from inherent hard metal alloys, such as nickel-cobalt. The present invention likewise has certain unique advantages when the stamper is made from bimetallic combinations such as when a hard metal, such as nickel or, more preferably, nickel-cobalt, is initially electroformed to form a hard surface layer for the stamper and then the hard layer is backed up with a second metal, such as copper.

The manufacture of the stamper 10 is commenced by initially electroforming the matrix referred to as a mother 26 in the conventional method. The electroformed mother 26 which is obtained will be a flat disc-shaped matrix which will be essentially identical to the starting recording substrate. It will have formed in its surface a flat unrecorded inner section, a recorded section with a positive copy of the spiral information track which was originally cut into the recording substrate, and a flat unrecorded outer section.

Figure 3:
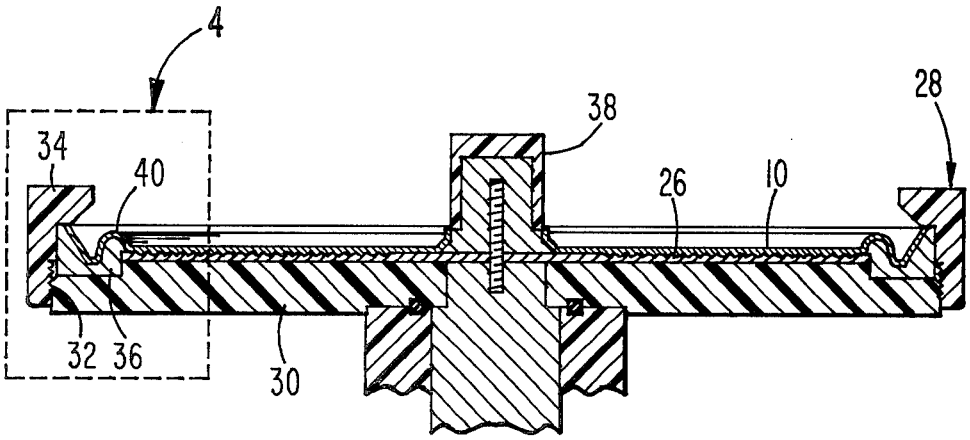
FIG. 3 is an illustration in cross section of an assembled cathode head which includes inner and outer electroforming guides in accordance with the preferred method of the present invention.
Figure 4:
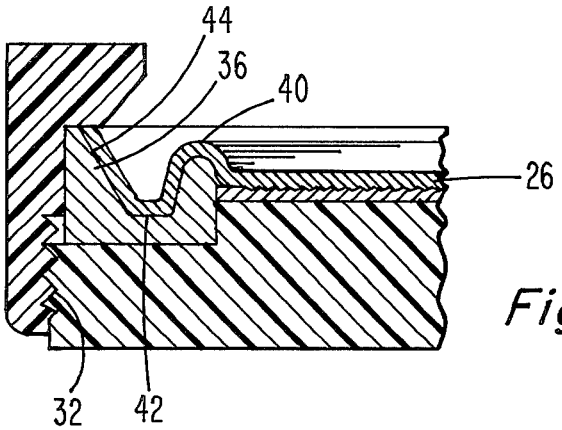
FIG. 4 is an enlarged illustration of the outer edge portion of the cathode head of FIG. 3 which is taken as indicated by the dotted lines and arrow 4 on FIG. 3.

As is illustrated in FIG. 4, the flat mother 26 is mounted and centered on a cathode head assembly 28 of an electroforming apparatus (not shown) which can be of conventional well-known design. The cathode head assembly 28 illustrated in FIG. 3 includes a disc-shaped support 30 made of a dielectric material, such as plastic, which is threaded on its outer edge 32 and a lock ring 34 which is threadably engaged with the outer edge 32 of the discshaped support 30. In accordance with the specific teaching of this invention, the cathode head assembly 28 also includes an outer edge electroforming guide 36 and a center electroforming guide 38. The outer edge and center electroforming guides 36, 38 are made of an electrically conductive, inherently passive material, such as stainless steel, or a material with a passivated surface to prevent adhesion of electroformed metal to the guides. The outer edge electroforming guide 36 is machined in the form of a one piece ring with the surface on which metal is to be electrodeposited being formed in a shape corresponding to the specified shape of the outer edge 18 of the stamper 10. The outer edge electroforming guide 36 has a curved portion 40 which corresponds to the curved section 20 of the stamper 10, a flat section 42 which corresponds to the flat section 22 of the stamper 10, and an outer section 44 which corresponds to the outer section 24 of the stamper 10.

Figure 5:
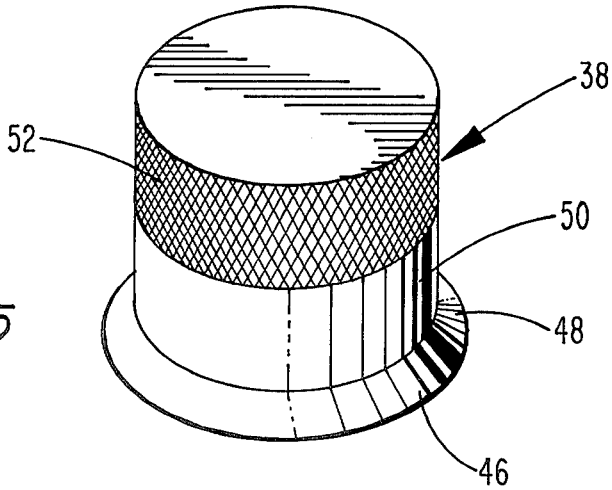
FIG. 5 is a pictorial illustration of the center electroforming guide used in the practice of the subject invention.

The center electroforming guide 38 illustrated in FIG. 5 is machined so as to be threadably engageable with the cathode head assembly 28. The bottom 46 of the center electroforming guide 38 is flat so as to seal tightly with the surface of a mother 26 mounted on the cathode head assembly 28. The outer surface of the center electroforming guide 28 is shaped so as to conform to the desired configuration of the inner edge 12 of the stamper 10. The outer surface of the center electroforming guide 28 has a beveled portion 48 and a right cylindrical portion 50. The right cylindrical portion 50 extends from the beveled portion 48 to a knurled cap 52 which is preferably made of a dielectric plastic onto which metal will not electrodeposit.

In the method of this invention, a flat mother 26 is positioned on the disc-shaped portion 30 of the cathode head assembly 28. The mother 26 is centered and the center electroforming guide 38 is threaded into engagement with the cathode head assembly 28 and tightened so as to secure the inner edge of the mother 26 to the cathode head assembly 28. The outer edge electroforming guide 36 is then positioned on the outer edge of the mother 26 so as to be concentric with the recorded area. The lock ring 34 is threaded onto the disc shaped support 30 of the cathode head assembly 28 and tightened to secure the outer edge electroforming guide 36 to the surface of the mother 26.

The entire assembly is then immersed in a electroforming bath and the metal or metals of which the stamper 10 is to be formed is electrodeposited in the conventional manner.

After a predetermined amount of metal has been deposited to form the specific thickness for the stamper 10, the electrodeposition is stopped. The outer lock ring 34 of the cathode head assembly 28 is removed. The stamper 10 is then stripped from the surfaces of the outer edge electroforming guide 36, the mother 26 and the center electroforming guide 38. The electroforming of stampers 10 can be repeated by screwing the lock ring 34 back onto disc shaped support 30 and electrodepositing metal to form additional stampers 10 as noted above.

Using the method of this invention, the stampers 10 are manufactured with the required formed inner and outer edges 12, 18. The electroformed stamper edges 12, 18 are more precise in dimensions than that of stampers having stamped edges. In addition, the problem of edge cracking commonly encountered with stampers having stamped inner and outer edges are virtually eliminated with the method of this invention. Since the stamper's 10 inner and outer edges 12, 18 do not have to be subjected to deformation by stamping, the stamper 10 can be electroformed from relatively hard metals which would normally crack during stamping, such as nickel-cobalt. There are also cost advantages in that trimming steps and inner and outer edge stamping steps are eliminated. The direct electroforming of the inner and outer edges 12, 18 also reduces the time required for manufacture of completed stampers.

The stamper 10 produced in accordance with this invention, particularly those electroformed from relatively hard deposits of metal have been found to produce high quality records and to have a long press life.

In describing the present invention, specific reference was made to the structural features of the stamper 10 illustrated in FIGS. 1 and 2. It should be appreciated, however, that the disclosed invention is not limited to the specific stamper configuration illustrated in FIG. 1, but can be used to form various types of stampers having formed inner and outer edges. In addition, certain aspects of the invention can be used independent of other aspects, such as only electroforming the the outer edge of the stamper and stamping the inner edge, without departing from the scope of the present invention.

I claim:

1. In the method for the manufacture of a record stamper having an inner edge of a first predetermined configuration, a recorded section having a negative information track defined therein and an outer edge of a second predetermined configuration; the improvement which comprises electroforming at least the outer edge of the stamper by providing a matrix having an unrecorded inner portion, a recorded portion having defined therein a positive information track corresponding to the negative information track and an unrecorded outer section; positioning an electroforming guide means having a configuration corresponding to the predetermined configuration of the edge to be electroformed at a preselected location on the matrix corresponding to the position of the edge of the stamper; electroforming a metal on the electroforming guide means and the matrix until a stamper of a preselected thickness is obtained; and separating the resultant stamper from the electroforming guide and the matrix, whereby a stamper is obtained having the edge thereof electroformed in the predetermined configuration.

2. The method according to claim 1 wherein only the outer edge is electroformed in the second predetermined configuration.

3. The method according to claim 1 wherein the inner edge is electroformed in the first predetermined configuration and the outer edge is electroformed in the second predetermined configuration.

* * * * *